United States Patent [19]

Frei

[11] 4,013,113

[45] Mar. 22, 1977

[54] FOLDABLE ROLLING SHUTTERS

[75] Inventor: Paul Frei, Elgg, Switzerland

[73] Assignee: Griesser AG, Switzerland

[22] Filed: June 28, 1976

[21] Appl. No.: 700,338

Related U.S. Application Data

[63] Continuation of Ser. No. 592,902, July 3, 1975, abandoned.

[30] Foreign Application Priority Data

July 3, 1974 Switzerland ..... 9097/74
Apr. 16, 1975 Switzerland ..... 4833/75

[52] U.S. Cl. ..... 160/36; 160/35
[51] Int. Cl.[2] ..... E06B 9/26
[58] Field of Search ..... 160/133, 187, 201, 202, 160/207, 229 R, 232, 33, 36, 37, 35, 231

[56] References Cited

UNITED STATES PATENTS

| | | | |
|---|---|---|---|
| 2,097,242 | 10/1937 | Robinson | 160/201 X |
| 2,390,116 | 12/1945 | Michelman | 160/133 |
| 2,586,561 | 2/1952 | Poggi | 160/33 |
| 2,987,120 | 6/1961 | Griesser | 160/133 X |
| 3,640,332 | 2/1972 | Luby et al. | 160/133 |

FOREIGN PATENTS OR APPLICATIONS

| | | | |
|---|---|---|---|
| 1,196,153 | 5/1959 | France | 160/232 |
| 465,683 | 9/1951 | Italy | 160/232 |

*Primary Examiner*—Philip C. Kannan
*Attorney, Agent, or Firm*—McGlew and Tuttle

[57] ABSTRACT

The shutter includes a curtain formed of elongated bars hinged to one another at longitudinal edges and guided at their ends in laterally spaced guide grooves extending along opposite sides of an opening to be controlled by the shutter. A rotatable member is mounted in an upper receiving zone, such as a lintel above the opening, and the rolling bar curtain is trained about this member for direction reversal during raising and lowering. The laterally spaced guide grooves extend along the peripheral portion of this rotary member and are then branched to form branch guide grooves extending downwardly from the rotatable element into a recess formed in the lintel or the like. Guide elements, such as pins or rollers on the ends of each bar, cooperate with the branch guide means to conjointly guide the bars to form at least one vertical pile of bars superposed in horizontal orientation in the recess, responsive to raising of the curtain. The rotatable element may be circular or may be polygonal and, if polygonal, has sides each conforming to the width of a bar of the curtain.

15 Claims, 23 Drawing Figures

FOLDABLE ROLLING SHUTTERS

This is a continuation of application Ser. No. 592,902 filed July 3, 1975, now abandoned.

FIELD AND BACKGROUND OF THE INVENTION

This invention relates to rolling shutters and, more particularly, to a novel foldable rolling shutter which, when raised, can be compactly folded into a very small space.

As is well known, the curtain of a rolling shutter of the kind concerned comprises flat bars which are hinged to one another along their longitudinal edges and, during the lowering and lifting, guided in laterally spaced grooves. In its open position, the curtain is usually rolled up on a drivable upper roller. With the presently usual high clearances of window openings, this leads to relatively bulky rolls requiring a correspondingly sized hood in the lintel recess. The needed space, particularly the depth of the recess perpendicularly to the wall face, is correspondingly large. That is why attempts have already been made, in particular with garage doors having wide bars, not to roll the curtain but to fold it to a bar pack located overhead and extending perpendicularly to the wall face, inwardly or outwardly. The pack formed by such folding has a relatively limited height given by the thickness of the bars, but its horizontal extension inwardly (or outwardly) is relatively large and, consequently not usable with conventional windows having relatively narrow lintel recesses, not to mention the relatively complicated folding mechanism.

SUMMARY OF THE INVENTION

The present invention, on the contrary, provides a foldable rolling shutter having a simple actuating mechanism and fitting into a narrow lintel recess such as, for example, provided for accommodating Venetian blinds, and thus requiring less space than a rolling shutter or a curtain which is foldable to a horizontal pack.

To this effect, in accordance with the invention, a mechanism is provided which is adapted to roll the bar curtain about an upper reversing area and to fold it, after the reversing area and due to the weight of the bars as well as to appropriate lateral guides, into at least one vertical pile of bars superposed in horizontal position in the lintel recess.

If the curtain comprises relatively wide flat bars, the bars can be piled up to a single pile. However, if the curtain is a window shutter with the usual relatively narrow bars, the curtain can be folded into two horizontally juxtaposed piles. Purposely, a rotatable lifting shaft is provided in the upper reversing area, having a triangular or polyhedral cross-section along its entire length or along some portions of its length, with the sides of the cross-section approximately corresponding to the width of the bars. While rotating the shaft in the lifting direction of the curtain, the advancing bars engage the polyhedral portions by which they are positively taken along and are deposited, at the runoff side and due to their own weight and also to guides which bring them into the correct position, into one or two piles in the lintel recess. Thus, the lifting shaft effects both the advance of the curtain into the open position and the breaking of the curtain about the hinge connections of the bars so that, under the effect of the guides, the curtain is folded in the lintel recess positively to the pile provided. Evidently, instead of using a polyhedral shaft, the breaking of the curtain in the upper reversing area in order to initiate the folding can also be effected merely by appropriate lateral guides for the bars, and the curtain might be lifted, for example, by means of an endless pull member (cable, chain or the like) acting on the lowermost bar, or by simply pushing it up.

In a particularly advantageous embodiment, a shaft is mounted in the upper reversing area and, for example, is connected to rotary drive means and is provided, at least along its portions serving as supports for the bars, with a polyhedral cross-section. Also advantageous is an embodiment in which a lifting shaft having a circular cross-section is provided as the support for the bars in the upper reversing area while an arcuate guide means surrounding the reversing area causes the bars to positively engage the shaft. To be sure, it has been found that a completely satisfactory circulation of the bars which, due to the hinge connections, are movable relative to each other to only a limited extent, may involve difficulties, particularly in cases where the curtain is to be folded into two juxtaposed piles. This means that adjacent bars, of the consecutively advancing bars, must be deviated, after the reversing area, in different directions. Also, it is necessary to deviate these bars differently to cause them to follow branch guides which extend in a spaced relationship. This implies, however, that the bars which, for example, are to be deviated toward the inside should follow a different track relative to the bars to be deviated toward the outside, already in the reversing area, if possible. The present invention permits overcoming of these difficulties. To this end, in accordance with the invention, a member rotating with and supporting the bars during a part of their motion around the reversing area is provided, and comprises engaging portions for bars to be deviated differently, which portions are located unsymmetrically relative to the reversing axis.

The unsymmetrically disposed engaging portions may be formed by mutually opposite faces of an irregular tetrahedral portion of a lifting shaft or by engaging recesses for guide pins of the bars, which are not necessarily diametrically opposite to each other and are provided at unequal radial distances. The obtained effect is that the bars to be deviated differently are released by the conveying member at locations which are radially differently spaced from the reversing axis, i.e., are transferred to different branch guide grooves provided after the reversing area.

An object of the invention is to provide an improved foldable rolling shutter.

Another object of the invention is to provide such a foldable rolling shutter having a simple actuating mechanism and fitting into a narrow lintel recess or the like.

A further object of the invention is to provide such a foldable rolling shutter which requires less space, when folded, than known foldable rolling shutters.

For an understanding of the principles of the invention, reference is made to the following description of typical embodiments thereof as illustrated in the accompanying drawings.

DESCRIPTION OF THE PREFERRED EMBODIMENTS

Figure 3:
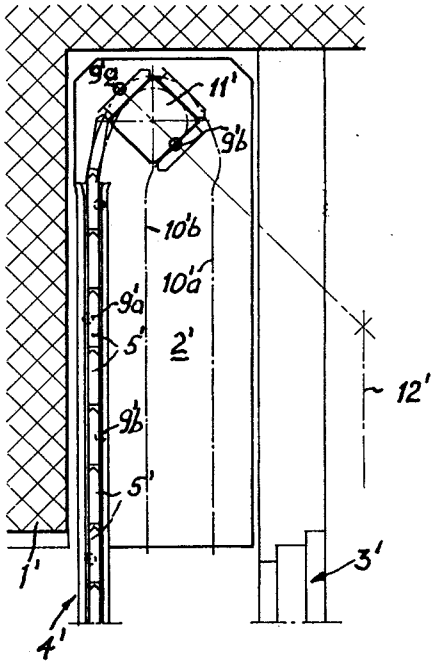
FIGS. 2 and 3 are sectional views similar to FIG. 1, respectively showing the rolling shutter during the lowering of the curtain and with a completely lowered curtain.
Figure 2:
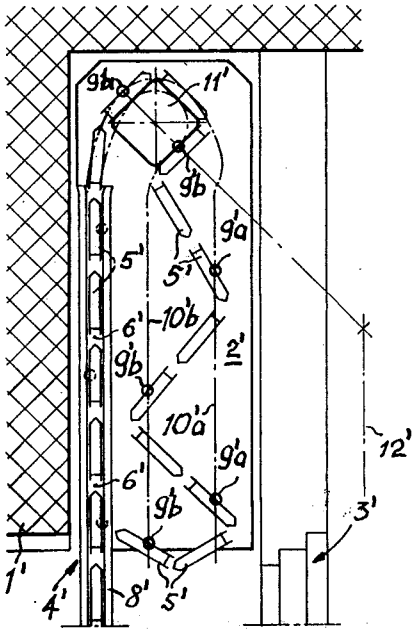
Figure 1:
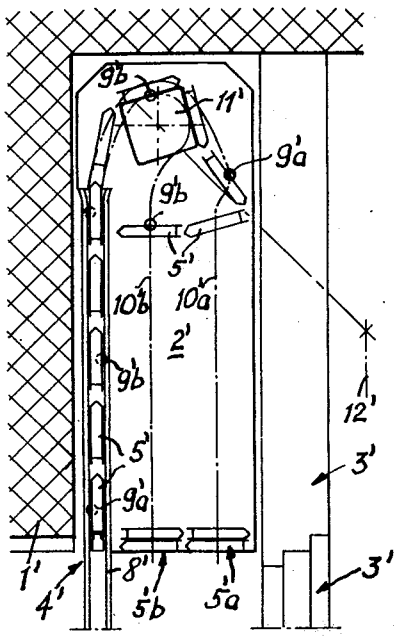
FIG. 1 is a vertical sectional view of a first embodiment of a roller shutter, the curtain being lifted and piled up in the lintel recess.
Figure 7:
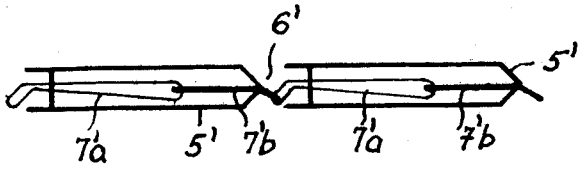
FIGS. 7, 8 and 9 are enlarged sectional views of a curtain showing different designs of the bars.

FIGS. 1 to 3 show a window lintel 1′ with a lintel recess 2′, a window 3′ and a rolling shutter 4′. The curtain of rolling shutter 4′ is formed of hollow bars 5′ which are hinged to each other along their longitudinal edges in a manner (not shown) such that they can be moved apart to a limited extent to form light slits 6′ or light-tightly engaged with each other, and also folded about their longitudinal edges to form a pile. Such a bar connection is shown, for example, in FIG. 7. In this case, the hinge connection of the bars is formed by chains passing through the bars and comprising partly bent chain links 7′*a*, 7′*b*, hooked together.

To guide the bars of the rolling shutter curtain in the lower position thereof, laterally spaced guide grooves 8′ are provided, while every other bar 5′ comprises end pins 9′*a*, 9′*b* located approximately at the mid-width of the respective bar and engaging grooves 8′. As shown in the drawing, pins 9′*a*, 9′*b* are alternately offset relative to the midplane of the curtain, pins 9′*a* being provided at the outside and pins 9′*b* at the inside of the midplane. At its upper end, where curtain bars 5′ are released, each groove 8′ forks into two mutually adjacent branch grooves 10′*a*, 10′*b* for pins 9′*a*, 9′*b* which are spaced from each other by a distance corresponding to the mutual spacing of offset pins 9′*a*, 9′*b*. The two branch grooves 10′*a*, 10′*b* extend along an arc of approximately 180° about the axis of an upper lifting shaft 11′ having at least two portions with tetrahedral cross-section located in spaced relationship along the rolling shutter. Relative to the tetrahedral cross-sections of the shaft, the arcuate portion of the radially external groove 10′*a* follows a circumscribed circle while the arcuate portion of the radially internal groove 10′*b* follows an inscribed circle. After the arcuate portion, approximately at the level of the axis of shaft 11′, the two branch grooves 10′*a*, 10′*b* commence to diverge up to a spacing approximately corresponding to the width of a bar. Upon reaching this spacing, grooves 10′*a*, 10′*b* extend in spaced parallel relation downwardly and end at the level of the lower opening of the lintel recess. Lifting shaft 11′ is associated, through an appropriate mechanism (not shown), with a hand crank 12′ for manual operation of the shaft.

The just described rolling shutter 4′ is operated in the following manner. FIG. 3 shows the rolling shutter with a completely lowered curtain. Since the lowermost bar 5′, or the usually provided end bar, rests against a bottom support, the complete lowering of the curtain results in the forming of a practically light-tight closing of the opening because, due to the hinge connections shown, for example, in FIG. 7, the mating bars 5′ engage into each other and close the light slits 6′. In the lowered position of the curtain, each of the uppermost three bars remains resting against a respective one of the lateral faces of the tetrahedral portions of shaft 11′ and these bars are held in this position by end pins 9′*a*, 9′*b* of the last but second and last bar 5′, respectively, of which the first-mentioned is guided in groove 10′*a* and the last-mentioned in groove 10′*b*.

While now turning lifting shaft 11′ by means of hand crank 12′ in the lifting direction of the curtain, thus clockwise in the drawing, the tetrahedral faces of shaft 11′ take the bars 5′ along. This results, first, due to the mentioned bar connections, in an opening of slits 6′ between curtain bars 5′ guided in groove 8′ and, thereupon, in a lifting of this part of the curtain. Bars 5′ advance consecutively to the tetrahedral portions of shaft 11′ while pins 9′*a*, 9′*b*, due to their offset positions, move in the associated branch grooves 10′*a* and 10′*b*, respectively. Bars 5′ leaving shaft 11′ in the lintel recess 2′, are guided, by pins 9′*a*, 9′*b* provided on only every alternate bar, in the branch groove portions 10′*a* and 10′*b* spaced from each other and extending downwardly in parallel so that, as shown in FIG. 2, the curtain is folded after every other bar. At the bottom end of lintel recess 2′, the two first consecutive bars 5′ are deposited side by side while the next two bars are superposed on the first two bars in a position reversed by 180° which, as shown in FIG. 1, upon a complete lifting of the curtain, results in two juxtaposed piles of bars 5′*a*, 5′*b* closing the lintel recess 2′ at the bottom. The relatively narrow lintel recess 2′ is thereby filled up in the best possible manner. To lower the curtain of the rolling shutter, lifting shaft 11′ is rotated in the opposite direction, counterclockwise, whereby the bars which have remained on the tetrahedral portions, and consequently, the entire curtain, are positively taken along in the lowering direction. Due to the weight of the bars, the light slits 6′ between the bars continuously leaving shaft 11′ and guided in grooves 8′ reopen and, of course, remain open if the rotation of lifting shaft 11′ is interrupted as soon as the lowermost bar 5′ (or the end bar) reaches its bottom end position. Thus, light slits 6′ can selectively remain open or be closed.

Figure 4:
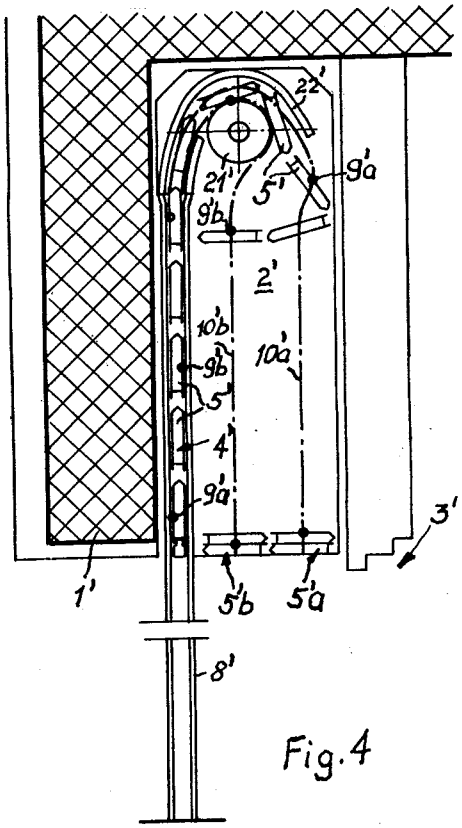
FIG. 4 is a vertical sectional view of a second embodiment of the invention, the curtain being lifted.

In the embodiment of FIG. 4 which, otherwise, corresponds to the embodiment according to FIG. 1, instead of the lifting shaft, a non-driven reversing roller 21′ is provided comprising axially spaced cylindrical portions or being cylindrical over its entire length. In this case, the lateral faces of the tetrahedral portions acting, in the first embodiment, as positive guides and engagement elements, are replaced by an appropriately curved guide sheet 22' associated with the arcuate portions of grooves 10'a, 10'b extending around the reversing area and with roller 21' serving as the radially internal support of the bars. From its position shown in FIG. 4 in which bars 5' in the lintel recess 2' form two juxtaposed piles 5'a, 5'b, the curtain is lowered, in this example, by pulling the endbar by hand. Analogously, the curtain is lifted by pushing it up, in which case guide sheet 22' ensures that the bars 5', of which again only every other one is positively guided in grooves 10'a, 10'b by means of end pins 9'a, 9'b, glide over reversing roller 21' without being lifted therefrom.

Figure 5:
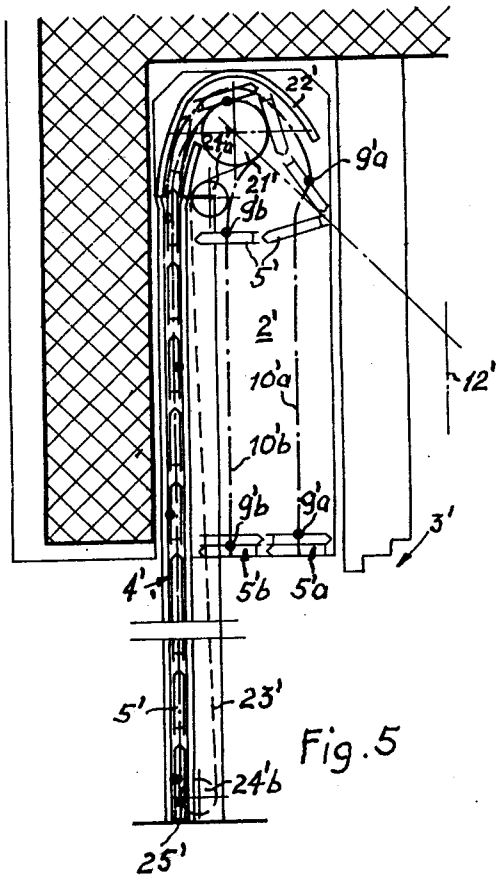
FIG. 5 is a vertical sectional view of a variant of the embodiment shown in FIG. 4, the curtain being lowered.

A variant of the embodiment of FIG. 4 is shown in FIG. 5. In this case, an endless chain 23' (or a V-belt or cable) is provided as the pull means for lifting and lowering the curtain of the rolling shutter which, otherwise, is designed in the same manner as the embodiment of FIG. 4. The chain is operable by means of hand crank 12' through a sprocket mounted on roller 21', and is passed around upper and lower idler wheels 24'a, 24'b. The lowermost bar 5' (or end bar) is connected to chain 23' by a dog 25'. Turning of lifting roller 21' in the clockwise direction results in a lifting, and turning in the opposite direction in a lowering, of the curtain.

In the foregoing, rolling shutters comprising relatively narrow bars (of the width of a few cm) have been considered, which can be deposited in any normal window lintel recess in the form of the mentioned double pile. Designs are possible, however, providing relatively wide bars in which case, to be sure, the usual narrow lintel recesses permit a folding of the curtain into only a single pile having a width corresponding to the width of a bar. Such a design is shown in FIG. 6.

Figure 6:
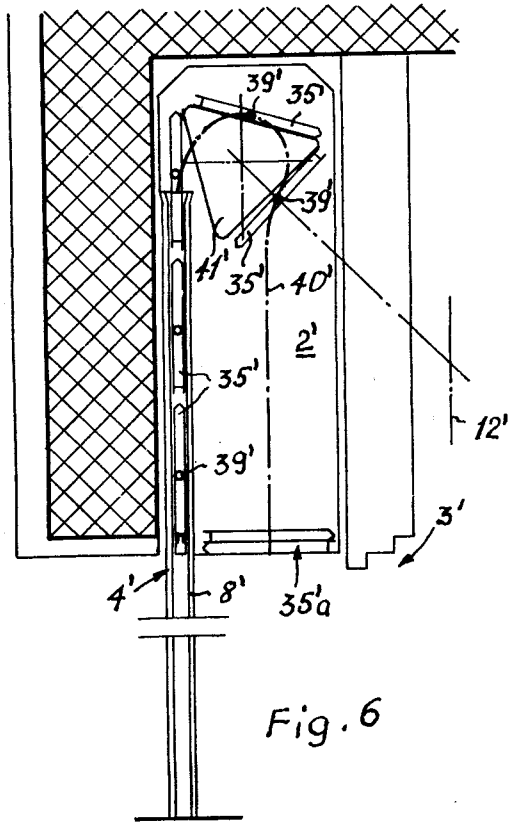
FIG. 6 is a vertical sectional view of a variant of the embodiment shown in FIG. 1.

In FIG. 6, the otherwise similarly designed bars 35' are approximately of a double width relative to the examples described hereinabove, and a correspondingly smaller number of bars is necessary for assembling a curtain having the same height. In this case, each bar 35' is provided with end pins 39' which are guided in a groove 40' starting from groove 8' and extending around the upper reversing area and, at the other side, again down to the lower opening of the lintel recess.

For positively guiding the bars and as a drive member, a lifting shaft 41' is associated with groove 40' in the reversing area, having a trihedral cross-section over its entire length or, at least, along some portions of its length. The length of the sides of this cross-section corresponds approximately to the width of a bar and the arcuate portion of groove 40' extending around the reversing area follows approximately a circle inscribed in the triangular cross-section. While rotating lifting shaft 41' in the lifting direction of the curtain (clockwise in FIG. 6), each of the advancing bars engages one of the lateral faces of shaft 41' and is taken along by the same and, upon leaving shaft 41', due to the guidance of the pins, bars 35' fold alternately to the one and to the other side and pile up, under their own weight, to a correspondingly folded pile 35'a.

Figure 8:
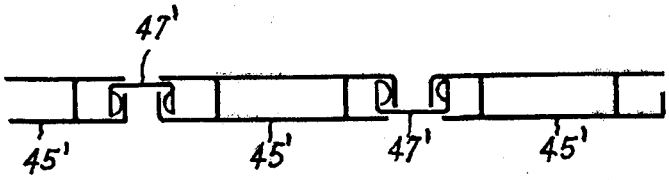
Figure 9:
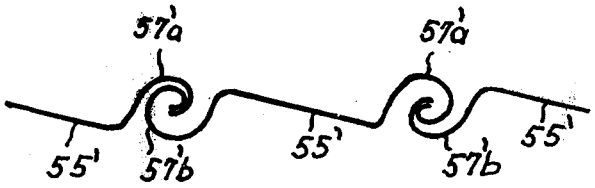

The described design makes it possible to utilize fully the space available in the lintel recess for piling up the lifted rolling shutter without an expensive construction for the bar guidance. The sole condition is to provide a hinge connection between the bars permitting an unhindered folding of the curtain. Bars movable relative to each other and thus permitting a formation of light slits, such as, for example, shown in FIG. 7 or at 45' in FIG. 8, are particularly suitable in this respect. In the bar design variant shown in FIG. 8, a perforated or transparent intermediate link 47' is provided as the hinge member establishing connection and permitting folding to both sides. Elastically flexible intermediate links could also be provided. As shown in FIG. 9, shaped slats 55' interlocked by edge flanges 57'a, 57'b may also be used.

The foldable rolling shutter shown in FIGS. 10 to 13 comprises a curtain formed of hollow flat bars 1a, 1b, 1c, 1d made, for example, of metal or plastics. These consecutively arranged bars are hinged to each other by means of hook links 2a, 2b and, as usual, guided in laterally spaced guide grooves 3. As shown in detail in FIGS. 16 and 17 and diagrammatically in FIGS. 10 to 13, two hinges 2a are always followed by two hinges 2b. Hinges 2a and 2b differ from each other in the orientation of their respective folding capability, hinges 2a being designed so as to permit a folding of the bars through 180° to the one side and hinges 2b being designed so as to permit a folding through the same angle to the opposite side. Concentric with the upper reversing axis *a* of the curtain, a lifting shaft 4 is mounted and is drivable, for example, through a handcrank mechanism.

Shaft 4 comprises tetrahedral portions 5 having an irregular cross-section, i.e., unsymmetrical relative to axis *a*. The arrangement is made so that the bars 1b situated between two hinges 2b (folded outwardly through 180°) engage the smallest tetrahedral face 5b and the bars 1d situated between two hinges 2a (foldable inwardly through 180°) engage the largest tetrahedral face 5d. Consequently, bars 1a engage the one (5a) and bars 1c against the other (5c) of the two remaining tetrahedral faces. Bars 1a and 1c situated between differently designed hinges 2a, 2b are provided, on their front faces, with guide pins 6a, 6b, respectively. Pins 6a of bars 1a are located at the outside of the midplane of the bars, i.e., offset relative to pins 6b with respect to this plane. In the reversing area, the common vertical lateral guide grooves 3 for pins 6a, 6b fork into separate branch guide grooves 3a, 3b which, after the reversing area, extend downwardly at a spacing corresponding to the distance by which pins 6a, 6b, in two juxtaposed piles of horizontally stacked bars 1a, 1b or 1c, 1d, are spaced from each other. To ensure a reliable taking along of the bar curtain in the reversing area, an engaging member 7 is firmly mounted on the end portion of shaft 4. The engaging member has two forked arms of which the radially shorter fork 7a is intended to engage over and take along pins 6a and the radially longer fork 7b extending in the opposite direction relative to fork 7a is intended to engage over and take along pins 6b. Such positively engaging members 7 are very advantageous, but they may also be omitted.

Figure 10:
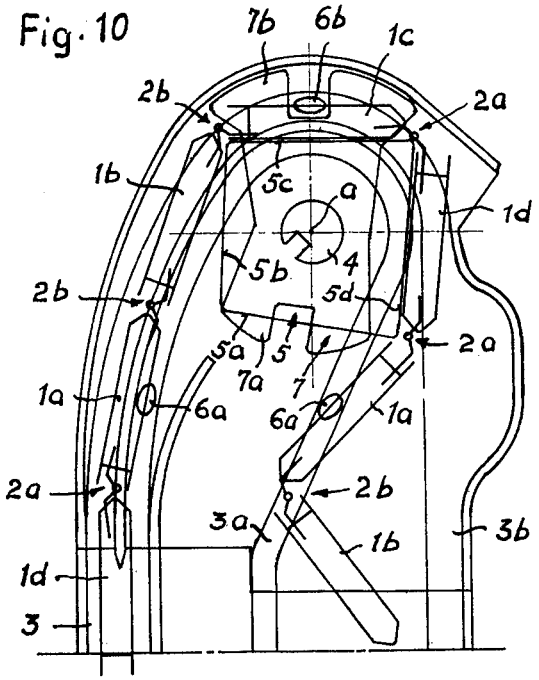
FIGS. 10 to 13 are vertical sectional views of the reversing area of a foldable rolling shutter comprising a tetrahedral lifting shaft having positively engaging portions, in four different positions of the shaft.
Figure 11:
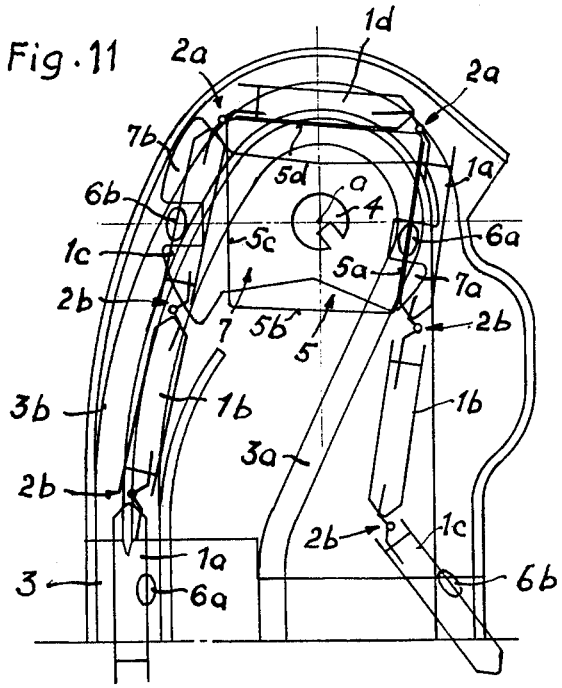
Figure 12:
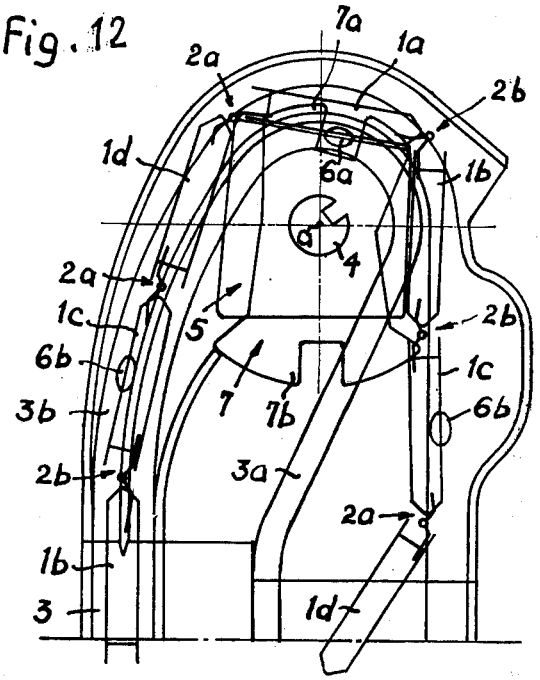
Figure 13:
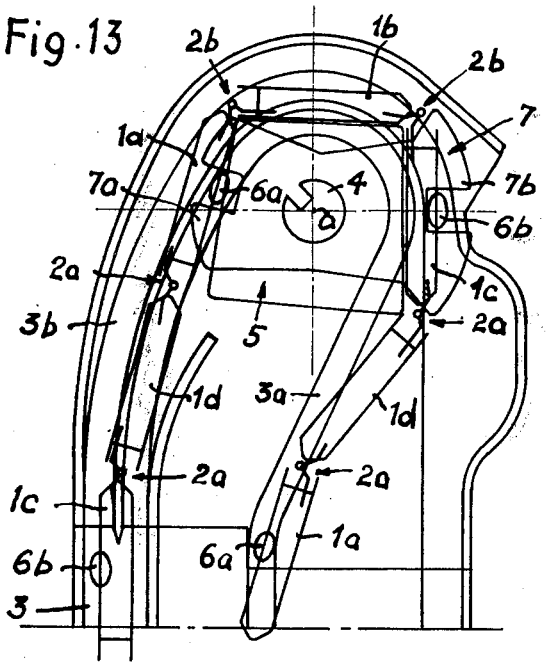

In FIG. 10, the curtain of the foldable rolling shutter is shown in its upper position clearing the window opening, in which position the main part of the curtain is folded after the reversing area to two piles placed side by side, such as shown in FIGS. 1, 4 and 5. By rotating lifting shaft 4 counterclockwise, the curtain of the rolling shutter is lowered. As may be seen in FIG. 11, during the first quarter turn, fork 7a engages over pin 6a of bar 1a coming into contact with tetrahedral face 5a while fork 7b disengages from pin 6b of bar 1c leaving tetrahedral face 5c. It is evident that, in this way, member 7 is permanently engaged with at least one pin 6a or 6b (see also the further quarter turns of shaft 4 shown in FIGS. 12 and 13) so that not only a secure motion of the curtain over the tetrahedral portion 5, but also a correct positioning of the individual bars on the associated tetrahedral faces, is ensured. During lifting of the curtain, i.e., rotating of lifting shaft 4 clockwise, the bars are guided through the reversing area in the opposite direction, i.e., following a sequence of FIG. 4, 3, 2 and 1.

Figure 14:
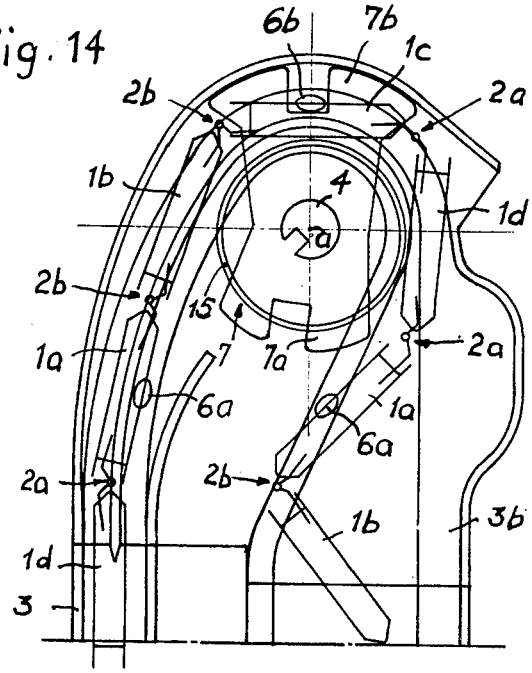
FIGS. 14 and 15 are views corresponding to FIGS. 10 and 12, respectively, showing a second embodiment of a foldable rolling shutter.
Figure 15:
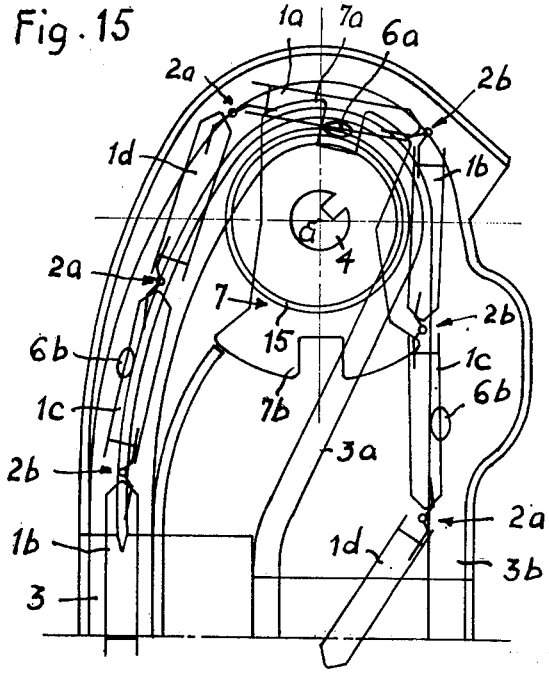
Figure 20:
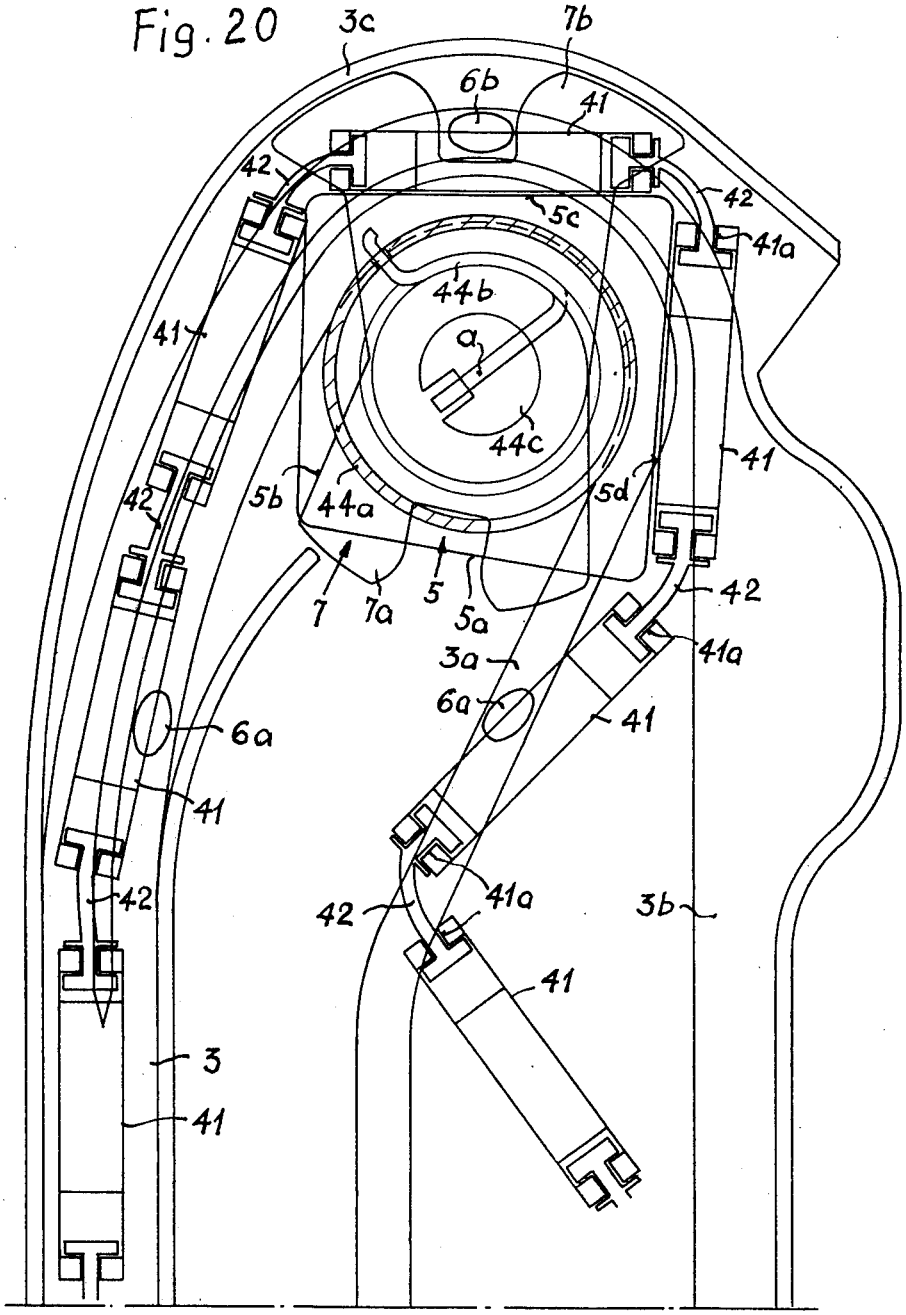
FIG. 20 is an enlarged view of a variant of the embodiment according to FIG. 10.

As shown in the example of FIGS. 14 and 15, cylindrical portions 15 may be provided instead of tetrahedral portions 5. In this case again, pins 6a, 6b are guided in grooves 3a, 3b and are positively moved through the reversing area by the engaging members 7 because, in any position, at least one of the pins is engaged with the associated fork of the engaging member. Otherwise, this foldable rolling shutter is also designed in accordance with FIGS. 10 to 13. It should be noted that, in this design, however, since the flat supporting faces for the bars are absent, an undesirable rising or deflection of the bars upwardly is prevented by the roof-like outer flange 3c (FIG. 20) of lateral guide groove 3 extending around the reversing area.

Figure 16:
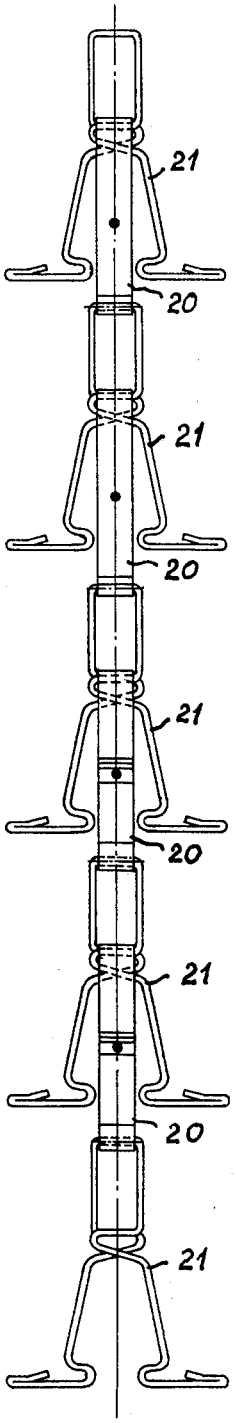
FIGS. 16 and 17 are a front and a lateral elevational view, respectively, of an embodiment of the hook connections of the curtain bars.
Figure 17:
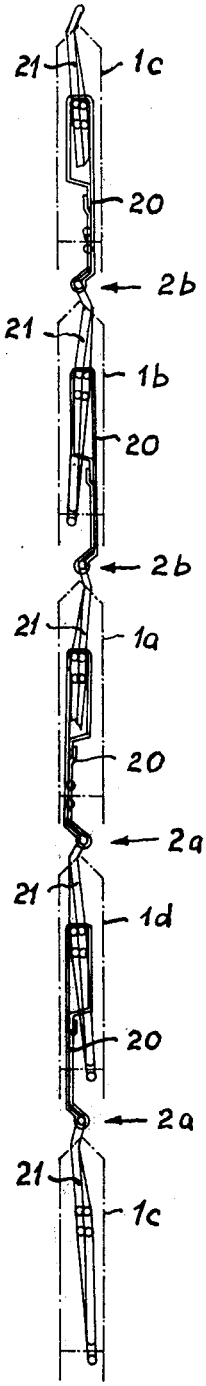

FIGS. 16 and 17 show details of an embodiment of the hinge connection of the bars which are used in foldable rolling shutters according to FIGS. 10 to 15. The hinges 2a and 2b are formed by pairs of links 20, 21 which are hooked to each other in the interior of hollow bars 1a – 1d. To form hinges 2a, the respective links are connected so that the hinge is completely foldable to the inside (considered in the position of the curtain shown in FIG. 10) and to form hinges 2b, the respective links are connected so as to permit a complete folding of the hinge to the outside. In the interior of the hollow bars, links 20 form an oblong loop into which links 21 are engaged in a manner such that a limited motion of the links toward and apart from each other and, thereby, a corresponding relative motion of the bars, are made possible. This not only permits the formation of light or air slits in a closed curtain but also ensures a completely satisfactory run of the bars through the reversing area.

Figure 18:
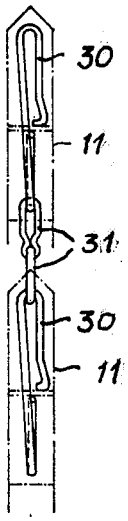
FIGS. 18 and 19 show a variant of the hook connections in views similar to FIGS. 16 and 17, respectively.
Figure 19:
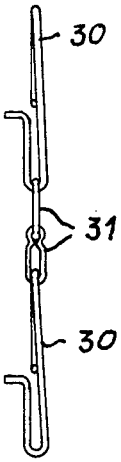

FIGS. 18 and 19 show a more simple hinge connection between the bars. While, according to FIGS. 16 and 17, the free, outwardly spread end portions of links 21 are firmly clamped in the rear cross web of the respective hollow bar, in this design, each bar is provided with an additional middle web against which the end of a hook link 30 engages. In the zone of the rear cross web of hollow bar 11, an oblong chain link 31 is suspended from hook link 30, and is engaged with a second chain link 31 from which the next hook link 30 is suspended. This ensures not only the required mutual displacement of the bars but also a trouble-proof foldability of the curtain.

In the examples described in the foregoing, it has been assumed that shaft 4 moving the rolling shutter is driven, for example, by a manually operated mechanism. However, it is also possible to lift or lower the curtain directly by pushing it up or pulling it down. Since, in such a case, while pushing the curtain up, the bars tend to deviate in the reversing area upwardly, i.e., instead of taking the tetrahedral portion along, to lift therefrom, in the variant shown in FIG. 20, the lifting shaft is designed as a spring roller. The tetrahedral parts 5 are secured to a cylinder 44a which is connected, by means of a spring 44b, to a shaft 44c fixed against rotation. The connection is provided so that, while cylinder 44a rotates counterclockwise (lowering of the curtain), spring 44b is tensioned and, while cylinder 44a rotates clockwise (lifting of the curtain), the tension of spring 44b is released and the spring supports the action. As for the remainder of the structure, guides 3, 3a, 3b, tetrahedral parts 5 and engaging member 7 correspond to the respective elements shown in the example of FIGS. 10 to 13. Here again, every other bar 41 is provided with a pin 6a or 6b located inside or outside, respectively, cooperating with guide grooves 3a and 3b as well as with engaging forks 7a and 7b.

In this variant, bars 41 are designed as hollow bars having their edges formed with undercut through-slots 41a. In these end slots, correspondingly shaped end portions of elastically flexible intermediate members 42 are received, which form flexible links between the bars. One of the edge slots of each bar, in the present example the front slot 41a considered in the lowering direction of the curtain, is deep enough to permit the flexible link to penetrate to a certain extent therein thereby enabling bars 41 to move through a limited distance toward or apart from each other. Thus, a troublefree run of the bars through the reversing area and folding of the curtain to the desired piles are made possible. The flexible links 42 may be provided with slits forming air openings while the curtain is appropriately lowered.

Figure 21:
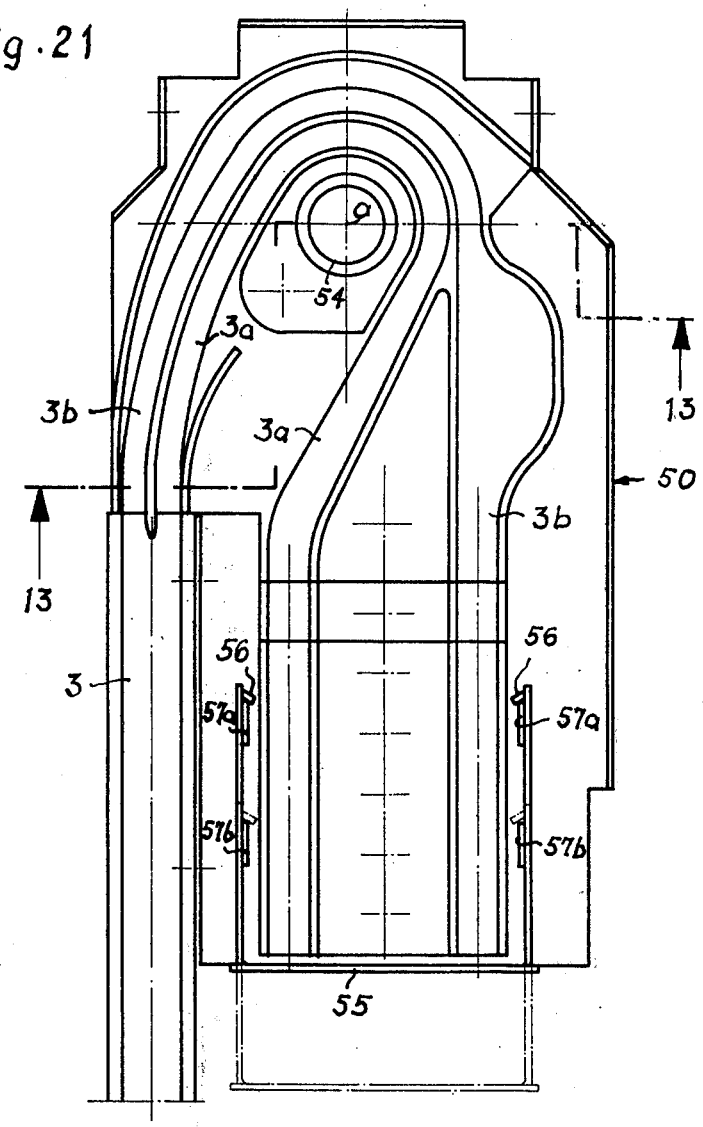
FIG. 21 and 22 are, respectively, a lateral elevational view and a sectional view taken along the line 13—13 of FIG. 21 of the guide elements in the reversing area.
Figure 22:
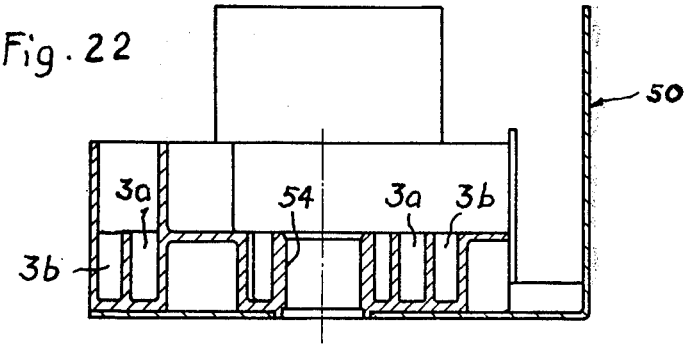

As may be seen from the foregoing, aside from a bearing for the lifting shaft, different guide grooves are needed in the reversing area, which must be disposed exactly relative to each other and to the reversing axis. A particularly advantageous solution of this problem is shown in FIGS. 21 and 22. At either side of the rolling shutter, a one-piece structural part 50 is provided, and is formed with the grooves 3a, 3b connecting to lateral groove 3, as well as with the bearing 54 for the lifting shaft. After the reversing area, grooves 3a, 3b diverge, are enlarged and extend downwardly to a channel member 55 serving as a bottom closure and support for the pile or piles of bars. The two flanges of channel member 55 are slightly springy and provided, in the zone of their free edges, with inwardly projecting tongues 56. On the back wall of structural part 50, outside the two grooves 3a, 3b, pairs of projections 57a, 57b are provided.

For assembling, the flanges of the channel member are pushed upwardly past the two pairs of projections until tongues 56 engage over the one or the other pair of projections. Since the height of the lintel recess is limited and must be fully utilized for the piling of the curtain, in assembled state, channel member 55 is in its uppermost position, i.e., its web is immediately adjacent grooves 3a, 3b and tongues 56 are engaged over the upper pair of projections 57a. The arrangement is made so that, with the curtain lifted, while the lowermost bars are still in lateral groove 3, the pile chamber formed above the web of the channel member is dimensioned just sufficiently to receive the bars which have passed behind the reversing area. However, to be able to receive the entire curtain in this pile chamber (thus in cases wherein the curtain is completely removed from the lifting shaft), channel member 55 can be partly lowered so that its tongues 56 engage over the lower pair of projections 57b. This provision of accommodating the curtain in the enlarged pile chamber makes it possible to transport and mount the rolling shutter along with the lifting shaft and the lateral structural parts 50 as a compact unit.

Figure 23:
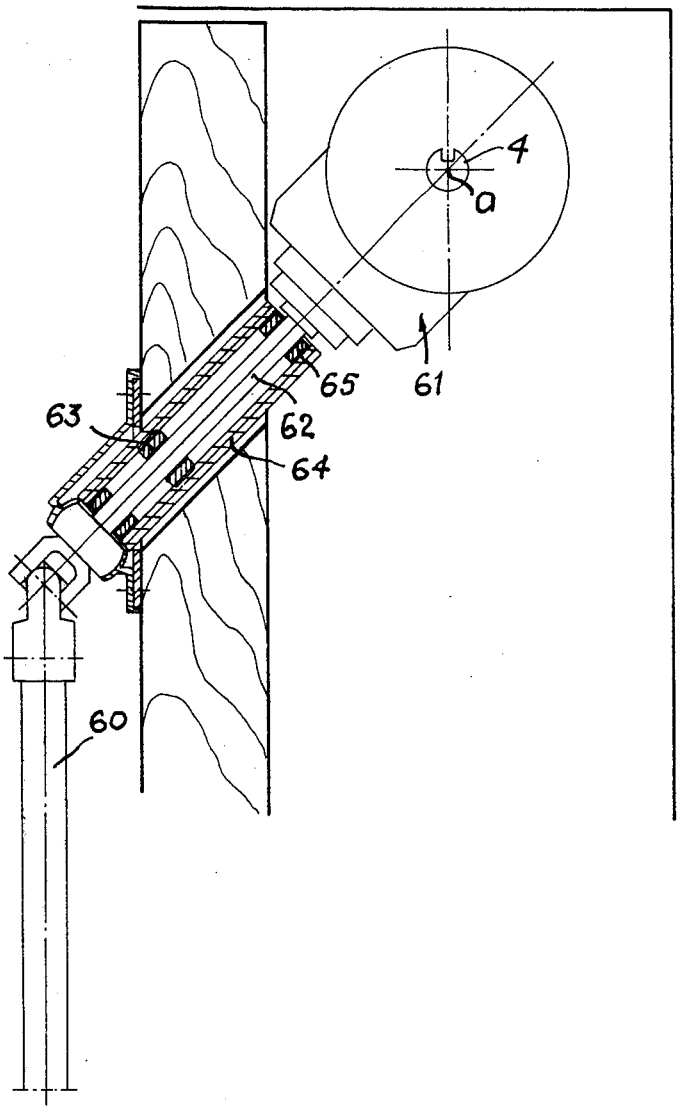
FIG. 23 is a sectional view of the drive mechanism of a foldable rolling shutter, comprising a limit stop arrangement.

FIG. 23 shows a hand-crank link 60 of a mechanism 61 driving the lifting shaft 4 of the rolling shutter. Between the mechanism and the crank connection, a square-section bar 62 is provided comprising an axially displaceable stop nut 63. Through an external thread, nut 63 engages in an internal thread of a fixed hexagonal sleeve 64 in which tops 65 are provided in adjustable fixed positions. While turning bar 62 by means of the crank, nut 63 turning therewith is displaced, in accordance with the direction of rotation, toward the one or the other of stops 65 whereby, the possible number of revolutions of the crank or lifting shaft 4 is limited.

While specific embodiments of the invention have been shown and described in detail to illustrate the application of the principles of the invention, it will be understood that the invention may be embodied otherwise without departing from such principles.

What is claimed is:

1. In a foldable rolling shutter including a curtain formed of elongated bars hinged to one another at longitudinal edges and guided at their ends in laterally spaced guide grooves, the improvement comprising, in combination, means, in an upper reversing zone, about which the rolling bar curtain is trained for direction reversal during raising and lowering; means forming a recess behind and below the reversing zone; and means effecting folding of the bar curtain within said recess under the weight of the curtain during raising of the curtain; said folding effecting means and said recess forming means conjointly guiding said bars to form at least one vertical pile of said hinged bars superposed in horizontal orientation in said recess.

2. In a foldable rolling shutter including a curtain formed of elongated bars hinged to one another at longitudinal edges and guided at their ends in laterally spaced guide grooves, the improvement comprising, in combination, means, in an upper reversing zone, about which the rolling bar curtain is trained for direction reversal during raising and lowering; and laterally spaced guide means extending downwardly from said means in said upper reversing area into means forming a recess, and engageable with guide elements on the ends of the bars for guiding the bars downwardly into the recess, under the weight of the curtain, during raising of the curtain; said guide means and said guide elements conjointly guiding said bars to form at least one vertical pile of said bars superposed in horizontal orientation in the recess.

3. In a foldable rolling shutter, the improvement claimed in claim 2, in which said guide elements comprise end pins projecting from alternate bars of said curtain; the end pins of successive alternate bars being offset, alternately to respective opposite sides of a vertical midplane of the curtain in its lowered position; said laterally spaced guide means comprising separate branch guide grooves each operable to engage the end pins offset in a respective direction from said vertical midplane; said separate branch guide grooves initially extending in parallel then diverging to a spacing from each other substantially equal to the width of a bar; said means forming a recess comprising a lintel above the opening controlled by the foldable rolling shutter; said separate branch guide grooves finally extending, after such diverging, parallel to each other to the bottom of the lintel recess.

4. In a foldable rolling shutter, the improvement claimed in claim 3, in which said means in said upper reversing zone comprises a rotatably mounted curtain lifting shaft; rotary drive means connected to said lifting shaft; at least two axially spaced portions of said lifting shaft having a polyhedral cross-section with side lengths corresponding substantially to the width of a bar; the surface of said polyhedral portions, during lifting and lowering of the curtain, serving as guide supports for the bars passing through the reversing zone.

5. In a foldable rolling shutter, the improvement claimed in claim 4, in which, in the reversing zone, said separate branch guide grooves for said end pins respectively follow a circle circumscribed about the tetrahedral cross-section of the lifting shaft and inscribed in the tetrahedral cross-section of the lifting shaft.

6. In a foldable rolling shutter, the improvement claimed in claim 3, in which said means in said upper reversing zone comprises a rotatably mounted reversing shaft formed, at least partly, with cylindrical portions which, during lifting and lowering of the curtain, serve as supports for the bars passing through the reversing area; and an external curved guide sheet for the bars substantially coaxial with the axis of rotation of said reversing shaft, and extending through a reversing angle of approximately 180°, disposed in radially spaced relation to the cylindrical portions of said reversing shaft for preventing bars not guided in grooves from being lifted from said reversing shaft.

7. In a foldable rolling shutter, the improvement claimed in claim 6, including a rotary drive unit connected to said reversing shaft; and an endless pull member operatively connected to said reversing shaft and connected to the lowermost bar of said curtain.

8. In a foldable rolling shutter, the improvement claimed in claim 2, in which said guide elements comprise end pins on each bar; said means forming a recess comprising a lintel above the opening controlled by said foldable rolling shutter; said laterally spaced guide means comprising laterally spaced guide grooves extending from said reversing zone to the bottom of said lintel recess; said means in said upper reversing zone comprising a rotatably mounted lifting shaft; rotary drive means operatively connected to said lifting shaft; said lifting shaft including at least some portions having a triangular cross-section with side lengths substantially equal to the widths of the bars; the faces of the triangular portions serving as guide supports for the bars passing through the reversing zone.

9. In a foldable rolling shutter, the improvement claimed in claim 1, in which said elongated bars are hinged to each other at their longitudinal edges by hinge connections providing for a limited displacement of the bars away from each other in order to form light clearances between adjacent bars.

10. In a foldable rolling shutter, the improvement claimed in claim 1, in which said means in said reversing zone comprises a member rotating with and supporting the bars during at least a part of the motion of the bars through the reversing area; said guide means comprising separate guide grooves which initially extend in spaced parallel relation to each other around said member, then diverge to a spacing substantially equal to the width of a bar and finally extend in spaced parallel relation to each other to the bottom of the recess; said bars being arranged in consecutive first and second pairs hingedly connected to each other and each including a first bar hingedly connected to a second bar; one of said last-named guide grooves cooperating with guide elements on the first bar of each first pair and the other of said last-named guide grooves cooperating with the guide elements on the first bar of each second pair; whereby, immediately successive bars are deviated in different directions; said rotatable member having bar engaging portions, for bars to be deviated differently, and which portions are located unsymmetrically relative to the axis of said rotatable member.

11. In a foldable rolling shutter, the improvement claimed in claim 10, in which said rotatable member has at least two tetrahedral portions having an irregular cross-section at fixed locations along its axis; the initially parallel portions of said last-named guide grooves extending in concentrically radially spaced relation around the axis of rotation of said member; said guide elements comprising guide pins extending from the ends of alternate guides; the guide pins on those alternate bars which are to be guided through the reversing zone in the radially external guide groove being located at the exterior of the midplane of the alternate bars, and the guide pins on the bars which are to be guided through the reversing zone along the radially internal guide groove being located at the inside of the midplane of the alternate bars.

12. In a foldable rolling shutter, the improvement claimed in claim 11, in which, considered consecutively in the lifting directions, the two hinge connections between a bar having an outside guide pin and a bar having an inside guide pin are identical with each other and provide for a folding of these bars through 180° inwardly; the two hinge connections between a bar having an inside guide pin and a bar having an outside guide pin being identical with each other and providing for a folding of the bars through 180° outwardly; the folding angles of the hinge connections in the respective opposite directions being, in each case, less than 180°.

13. In a foldable rolling shutter, the improvement claimed in claim 11, in which, in the reversing zone, two laterally spaced integral structural parts are provided and are formed with the circular portions of said last-named guide grooves extending about the axis of rotation of said rotatable member at different radial distances, said last-named guide grooves terminating in a pile chamber; said structural parts being formed with bearings for the shaft of said rotatable member; a channel member forming the bottom of the pile chamber; and interengageable engaging elements on said structural parts and on said channel member providing for said channel member to be adjustable in height.

14. In a foldable rolling shutter, the improvement claimed in claim 11, including an engaging member secured to rotate with said rotatable member and formed with two diametrically opposite forked portions of unequal radial lengths; one forked portion cooperating with the guide pins located at the outside of the midplane of the alternate bars and the other forked portion cooperating with the guide pins located at the inside of the midplane of the alternate bars.

15. In a foldable rolling shutter, the improvement claimed in claim 14, in which said rotatable member has fixed cylindrical portions serving as supports for the bars.

* * * * *